United States Patent [19]

Salice

[11] Patent Number: 4,800,625

[45] Date of Patent: Jan. 31, 1989

[54] BASE PLATE ASSEMBLY PERMITTING TRANSVERSE DISPLACEMENT

[75] Inventor: Luciano Salice, Carimate, Italy

[73] Assignee: Arturo Salice S.p.A., Novedrate, Italy

[21] Appl. No.: 14,399

[22] Filed: Feb. 13, 1987

[30] Foreign Application Priority Data

Feb. 17, 1986 [DE] Fed. Rep. of Germany ..... 3604984
Jul. 30, 1986 [DE] Fed. Rep. of Germany ... 8620441[U]

[51] Int. Cl.[4] ..... E05D 5/00; E05D 7/04

[52] U.S. Cl. ..... 16/382; 16/237; 16/DIG. 43

[58] Field of Search ..... 16/237, 238, 242, 243, 16/245, 246, 248, 288, 302, 370, 382, 383, 384, DIG. 43

[56] References Cited

U.S. PATENT DOCUMENTS 4,091,499 5/1978 Lautenschlager ..... 16/242

FOREIGN PATENT DOCUMENTS 3022440 1/1981 Fed. Rep. of Germany ..... 16/382

*Primary Examiner*—Fred A. Silverberg
*Attorney, Agent, or Firm*—Fleit, Jacobson, Cohn & Price

[57] ABSTRACT

A baseplate assembly for mounting a hinge bracket of a furniture hinge or the like comprises a base plate, which is adapted to be secured to a carrying wall or the like by fixing screws, and a cover plate, which covers or partly overlaps the base plate and is guided on the same transversely to the hinge bracket or the like. The base plate is formed in its end portions with bores for receiving fixing screws, which bores register with intermediate portions of slots, which are formed in luglike lateral extensions of the cover plate and extend on the line connecting the bores, and the bores are defined at least in part by projections, which serve as guides for the side faces of the slots.

22 Claims, 4 Drawing Sheets

BASE PLATE ASSEMBLY PERMITTING TRANSVERSE DISPLACEMENT

BACKGROUND OF THE INVENTION

1. Field of the Invention

This invention relates to a base plate assembly for mounting a hinge bracket of a furniture hinge or the like, which base plate assembly comprises a base plate, which is adapted to be secured to a carrying wall or the like by fixing screws, and a cover plate, which covers or partly overlaps the base plate and is guided on the same transversely to the hinge bracket or the like and provided with means for fixing the hinge bracket.

2. Description of the Prior Art

A base plate assembly of that kind is known from Published German application No. 30 22 440 and particularly permits a vertical adjustment of the hinge bracket relative to the furniture. That known base plate assembly comprises a base plate, which is provided on one side with mutually opposite projecting ribs, and a cover plate, which is formed on one side with grooves and is adapted to be mounted on said base plate so that said ribs are slidably received by said grooves. On the other side, the cover plate is formed with a slot for receiving a clamp screw for locking the cover plate against a displacement. That clamp screw is screwed into a tapped bore of the baseplate and prevents a shifting of the cover plate. That known base plate assembly is unduly complicated because the base plate as well as the cover plate must be provided on one side with mating guide means which permit said plates to be laterally displaced relative to each other.

Various base plate assemblies are known which serve to mount hinge brackets or the like and consist of pressure die castings made of a zinc alloy known as Zamak. The cover plate of said base plate assemblies is formed with a rectangular groove, which extends across the intermediate portion of the cover plate into huglike lateral extensions which cover the base plate. The intermediate portion of the cover plate serves to mount the hinge bracket. The base plate extends in said groove and guides the cover plate in that the side edges of the base plate are in sliding contact with the side faces of said groove. Base plates and cover plates consisting of pressure die castings are relatively expensive.

SUMMARY OF THE INVENTION

It is an object of the assembly to provide a base plate assembly which is of the kind described first hereinbefore and in which the means permitting a transverse displacement of the cover plate relative to the base plate are so simple that the assembly can be manufactured with a low expenditure which justifies mass production.

In a base plate of the kind described first hereinbefore that object is accomplished in that the base plate is formed in its end portions with bores for receiving fixing screws, which bores register with intermediate portions of slots, which are formed in luglike lateral extensions of the cover plate and extend on the line connecting said bores, and said bores are defined at least in part by projections, which serve as guides for the side faces of the slots.

In the base plate assembly in accordance with the invention a desired transverse displacement of the hinge bracket or the like relative to the base plate can be effected in that the cover plate is displaced relative to the base plate to a desired position and the base plate can then be fixed in position on the base plate by means of fixing or clamp screws.

In an embodiment of the invention the projections extend through the slots in the cooper plate, which bears on the base plate, the projections protrude above the top surfaces of the extensions, the cover plate and particularly one of its extensions is formed with a third slot, which is parallel to the first-mentioned slots, and a headed clamp screw extends through said third slot and is screwed into a tapped bore in the base plate. In that embodiment of the base plate assembly the base plate is secured to a carrying wall or the like in that the heads of the fixing screws screwed into the base plate bear on the projections, by which the bores in the base plate are surrounded at least in part. Because the projections protrude above the slots in the cover plate, the latter will be transversely slidable on the base plate even when the latter has been fixed by the fixing screws. As a result the cover plate, which carries the hinge bracket or the like, can be adjusted relative to the base plate, e.g., in order to effect a vertical adjustment of a hinge. After such adjustment the clamp screw is tightened to fix the cover plate to the base plate. During the manufacture of the assembly the cover plate is suitably fixed to the base plate in an intermediate position by means of the clamp screw so that the base plate can be mounted and it will then be sufficient to loosen the clamp screw when an adjustment of the cover plate is required.

The projections preferably have the same width as the slots so that the cover plate is guided on the projections extending into the slots.

The projections extending in the slots may be provided only on mutually opposite sides of the bores in the base plate and in that case the width of the projections will equal the diameter of the bores in the base plate.

The base plate may be substantially rectangular and the cover plate may be cross-shaped. The cover plate is suitably symmetrical with respect to its longitudinal center line so that the hinge bracket secured to the cover plate may protrude from the latter to the left or right.

The cover plate may be formed in its underside surface with a transverse groove, which has end portions disposed in the lateral extensions, and the cover plate may be guided by the contact of the side faces of the groove with the side edges of the substantially rectangular base plate. In that case the cover plate is guided by the side faces of the base plate rather than by the projections.

In another embodiment of the base plate assembly according to the invention, the third slot and the clamp screw screwed into the base plate are omitted and one of the projections is so much shorter that it terminates in one of the slots below the top edge of the latter. When it is desired in that case to adjust the hinge bracket which has been secured to the cover plate, e.g., for such an adjustment in a vertical direction, the fixing screw that has been screwed into the bore in the shorter projection must be loosened to permit the transverse displacement. That fixing screw must subsequently be screwed in again in order to fix the cover plate. The fixing screw which is to be loosened for an adjustment is suitably marked with an arrow.

In another embodiment of the invention the projections extend only in part of the height of the slots in the cover plate. In that embodiment of the base plate assembly in accordance with the invention the base plate can be substantially fixed by the fixing screws against a displacement in the longitudinal and transverse directions before the fixing screws are finally tightened. In that condition of the assembly the cover plate carrying the hinge bracket can be displaced on the base plate in the transverse direction of the hinge bracket in order to adjust the latter. In that case the projections extending in the slots provide an exact guidance. As soon as the cover plate has been adjusted relative to the base plate to the desired elevation, the fixing screws can be finally tightened in order to fix the cover plate in position. Because the projections of the base plate serve only for guiding and do not extend throughout the height of the slots, an adequate clearance will be provided between the top faces of the guiding projections and the top face of the cover plate so that the fixing screws can be tightened to fix the cover plate.

The base plate assemblies in accordance with the invention can be made at a lower cost than the known base plate assemblies consisting of pressure die castings because the cover plate can now be made of sheet steel. A cover plate made by die-forming from sheet steel usually cannot be made with such a precision that it is formed on its underside with grooves for guiding a base plate. In the base plate assembly in accordance with the invention the cover plate is guided relative to the base plate in slots, which are formed in the cover plate and receive projections of the base plate so that the invention readily permits the use of a cover plate consisting of a die-formed sheet steel element.

If the cover plate is made of sheet steel, the luglike extensions are suitably formed with peripheral stiffening edge portions which are angled to form depending flanges. Said flanges of the cover plate may suitably cover the side edge faces of the base plate so that the latter will not be visible when the assembly has been completed. For that purpose the thickness of the base plate is smaller than the height of the depending flanges of the cover plate.

The flanges which extend in U-shape around the extensions suitably merge via rounded corner portions into depending parallel side edge flanges of the intermediate portion of the cover plate, which intermediate portion serves to mount the hinge bracket.

The projections are suitably rectangular in a top plan view.

In an embodiment of the invention the base plate is made of plastic and the projections are an interference fit in the intermediate portion of the slots. In that case the base plate assembly can normally be mounted with the projections located in an intermediate position and an adjustment will have to be effected only when it is actually required.

The base plate is suitably provided on its underside with plugs, which are integral with the base plate and permit the base plate to be held in position before the fixing bores.

In a desirable embodiment the base plate is provided adjacent to each projection with a bore portion which has a diameter that is at least as large as the diameter of the screw threads of the fixing screw. That design ensures that that portion of the projection of the base plate which serves for guiding will not be expanded by the fixing screw so that there will be no jamming and no excessive friction between parts which serve for guiding.

Within the scope of the invention each bore in the base plate may have a length portion which is smaller in diameter than the screw threads of the associated fixing screw. In that case the fixing screws may provisionally be screwed into the bores to some extent so that the screws will be retained in the bores and can be finally tightened when the plugs or the leading ends of the fixing screws have been inserted onto the predrilled fixing bores.

That length portion of the bore which is smaller in diameter and serves for a provisional mounting of the fixing screw is suitably disposed adjacent to the plane of the base plate.

DETAILED DESCRIPTION OF THE PREFERRED EMBODIMENTS

Figure 1:
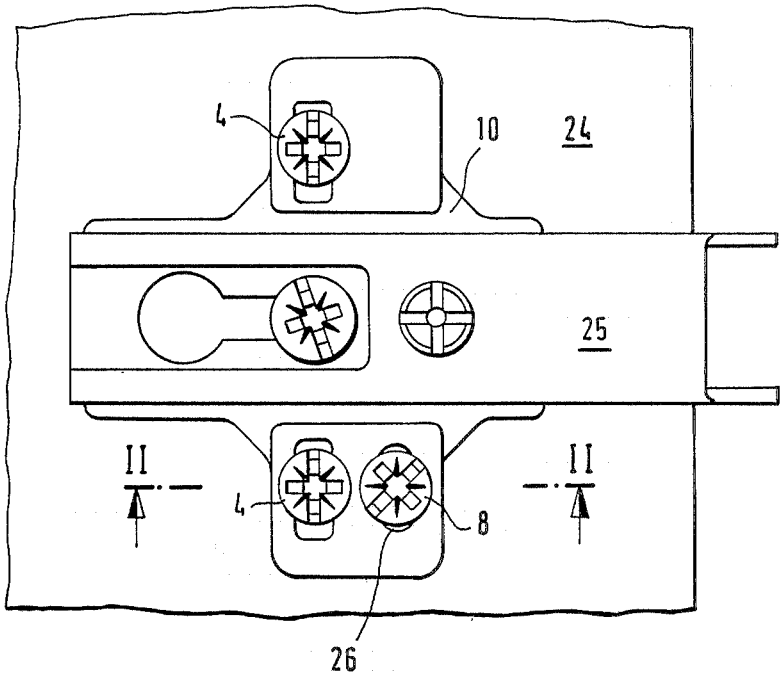
FIG. 1 is a top plan view showing a base plate assembly and a hinge bracket that is fixed by screws to the cover plate of said assembly.
Figure 2:
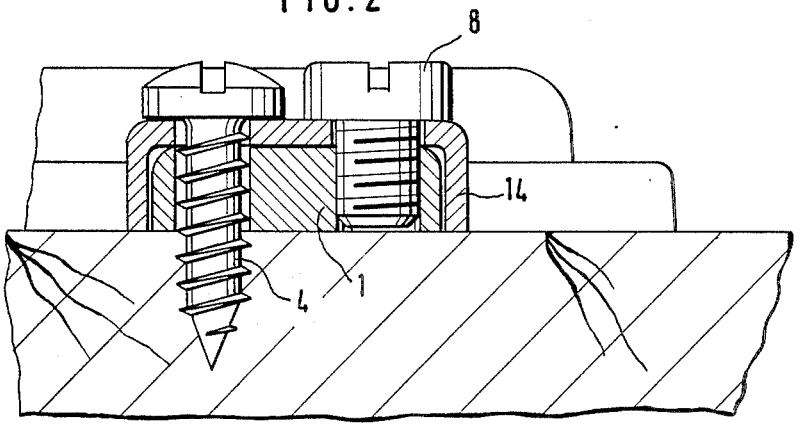
FIG. 2 is a sectional view taken on line II—II in FIG. 1 and shows the cover plate.
Figure 4:
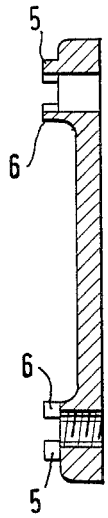
FIG. 4 is a sectional view taken on line IV—IV in FIG. 3 and shows the base plate.

Illustrative embodiments of the invention will now be described more in detail with reference to the drawing.

Figure 3:
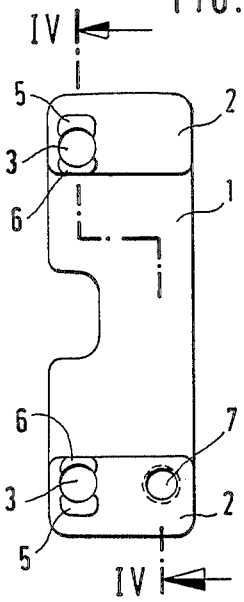
FIG. 3 is a top plan view showing the base plate.
Figure 5:
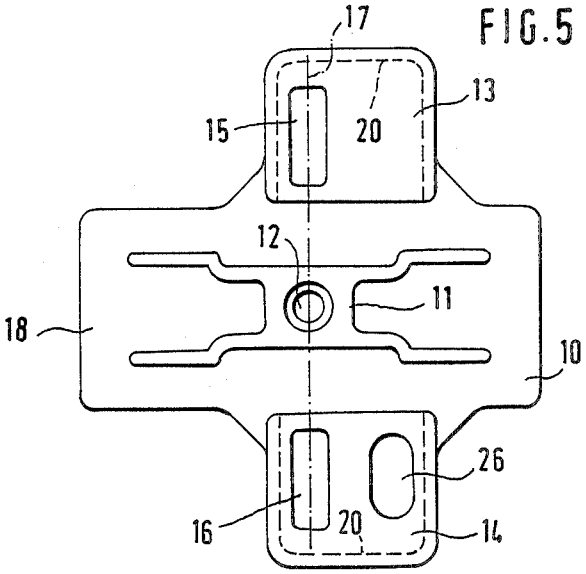
FIG. 5 is a top plan view showing the cover plate.

As is shown in FIG. 3 the base plate 1 is generally rectangular. Just as the cover plate, the base plate may consist of a pressure die casting or the like. The base plate has an intermediate portion and end portions 2, which are thicker than the intermediate portion and are provided with eccentric bores 3, which are symmetrical with respect to the transverse center line and serve to receive fixing screws 4. On their inwardly and outwardly facing sides, the bores 3 extend in and are partly surrounded by projections 5, 6, which have a width that is subsequently as large as the diameter of the bores 3, 4. Instead of two projections, a single projection disposed only on one side of the bore might be provided.

The base plate 1 is provided on one side also with a tapped bore 7 for receiving a clamp screw 8.

The cover plate 10 is provided on its top surface with an H-shaped projection 11, which is formed at its center with a tapped bore 12 and serves to retain the hinge bracket 25. The cover plate 10 is provided with winglike lateral extensions 13, 14, which are formed with slots 15, 16, which are disposed on a common transverse center line 17 of an intermediate portion 18, which is provided with the retaining projection 11. The winglike lateral extensions 13 of the cover plate 10 are formed on the underside with a recess 20, which is indicated by dotted lines and is adapted to receive and fit the base plate 1. The side faces of the recess of the cover plate are in sliding contact with the side edges of the base plate 2. The recess is longer than the base plate so that the covered plate 10 can be displaced across the base plate 1. When the cover plate 10 has been fitted on the base plate 1, the projections 5, 6 extend in and through the slots 15, 16 so that the top end faces of the projections are disposed above the top faces of the winglike extensions 13, 14.

FIG. 1 shows the hinge bracket 25 which is fixed in position and indicates how the base plate 1 is secured to the side wall 24 of the furniture by the fixing screws 4. For an adjustment in height it is sufficient to loosen the clamp screw 8 and to retighten it when the cover plate 10 has been shifted to the desired position.

Figure 7:
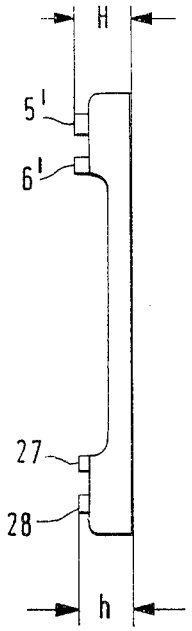
FIG. 7 is a side elevation showing the base plate of FIG. 6.
Figure 6:
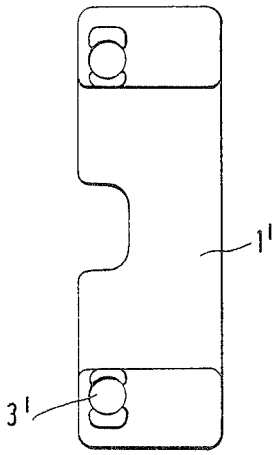
FIG. 6 is a top plan view showing the base plate of a second embodiment of the base plate assembly.
Figure 8:
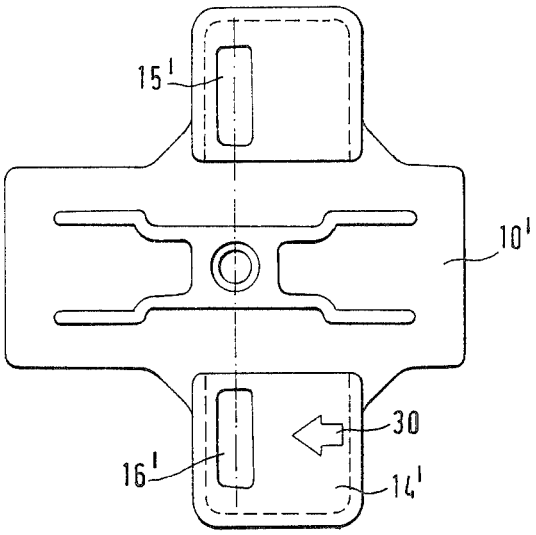
FIG. 8 shows the cover plate associated with the base plate of FIGS. 6 and 7.
Figure 9:
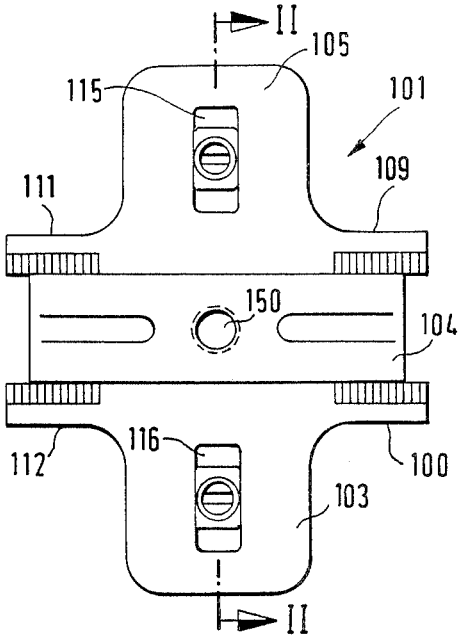
FIG. 9 is a top plan view showing a different embodiment of a base plate assembly consisting of a base plate and a cover plate.

The embodiment shown in FIGS. 6 to 8 differs from that shown in FIGS. 1 to 5 in that the clamp screw 8, the third slot 26 and the tapped bore 7 have been omitted and the projections 27, 28 have a smaller height so that they do not extend throughout the slot 16'. On the other hand, the projections 5', 6' have the same height as the projections on the base plate of the embodiment described hereinbefore. The height h of the projections 27, 28 is smaller than the height H of the projections 5', 6'. The shorter projections 27, 28 are associated with the slot 16' which is formed in the winglike extensions 14' and which is marked with an arrow so that the assembler will recognize immediately which of the two fixing screws serves to clamp the cover plate 10' in position on the base plate 1'. When the base plate assembly of FIGS. 6 to 8 has been fixed and an adjustment in height is substantially required, the fixing screw extending through the slot 16' of the cover plate 10' and through the bore 3' in the base plate 1' is loosened before and is retightened after the adjustment.

In the embodiment shown in FIGS. 9 to 12 the base plate assembly 101 comprises a base plate 102, which is rectangular with rounded corners in a top plan view, and a cover plate 103, which entirely covers the base plate 102.

The cover plate 103 consists of a dieformed sheet steel part and comprises an outwardly protruding channel-shaped intermediate portion 104, which serves to retain the hinge bracket, which is usually channel-shaped. The flanges of the hinge bracket, which is not shown, embrace the channel-shaped projection 104, which at the center of its length is formed with a tapped bore 105 for receiving the screw for fixing the hinge bracket.

The channel-shaped intermediate retaining portion 104 of the cover plate is provided with flangelike lateral lugs 105, 106, which are used in securing the base plate assembly, and specifically the cover plate 103 and the base plate 102, to a carrying wall or the like. Said luglike lateral extensions are formed with a depending peripheral flange portion 107, 108, which extends beyond the adjoining side portions 109, 110, 111, 112 of the central portion.

The cover plate 103 is symmetrical with respect to its longitudinal center line and with respect to its transverse center line II—II so that the base plate assembly 101 can be used with a hinge which is mounted on the right or left of an opening.

The luglike lateral extensions 105, 106 of the cover plate 103 are formed with slots 115, 116 having center lines which are aligned with the transverse center line II—II.

Figure 10:
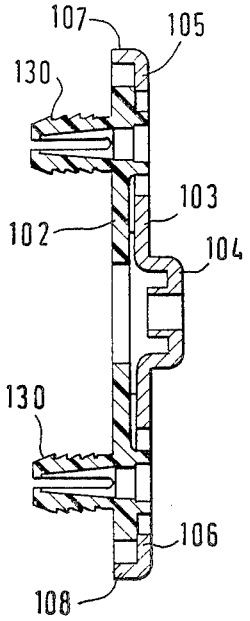
FIG. 10 is a sectional view taken on line II—II in FIG. 9 and showing the base plate assembly.
Figure 11:
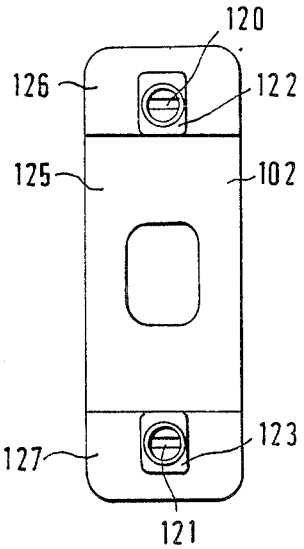
FIG. 11 is a top plan view showing the base plate when the cover plate has been removed.
Figure 12:
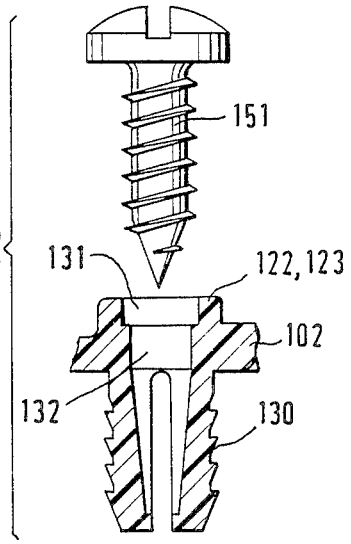
FIG. 12 is a sectional view showing on a larger scale that portion of the base plate which is integrally formed with plugs and is provided with fixing screw.

The base plate 102 is substantially rectangular and as is shown in FIG. 10 is covered at its side edges by the flanges 107, 108 of the luglike extensions 105, 106 of the cover plate 103. The end portions of the base plate are formed with bores 120, 121, which lie on the longitudinal center line of the base plate and serve to receive fixing screws 123. The bores 102, 121 are defined by projections 122, 123, which are rectangular in a top plan view and have side faces which in the completed assembly are in contact with the side faces of the slots 115, 116 of the cover plate 103. The height of the projections 122, 123 is less than the thickness of the sheet of which the cover 103 is made so that the projections 122, 123 do not extend through the slots 115, 116. As is apparent from FIGS. 9 and 10 the projections 122 are shorter than the slots 115, 116 so that the cover plate 103 can be displaced on the base plate 102 along the transverse center line II—II and an exact guidance is ensured by the side faces of the projections 122, 123 in contact with the side faces of the slots 115, 116.

To permit a lateral displacement of the cover plate 103 the base plate 102 is clear of the flanges 107, 108 of the cover plate 103 when the latter is in its central position. Because the cover plate 103 is guided by the projections 122, 123 of the base plate 102, a clearance is provided between the side edges of the base plate 102 and the flanges of the luglike lateral extensions 105, 106 of the cover plate 103.

The base plate 102 comprises an intermediate portion 125, which has a relatively small thickness, and end portions 126, 127, which has a relatively large thickness. But those portion 126, 127 of the base plate 102 which have a relatively large thickness are thinner than the height of the flanges 107, 108 of the luglike lateral extensions of the cover plate 103. As a result, the luglike extensions 105, 106 of the cover plate 103 completely cover the adjacent portions of the base plate 102.

Adjacent to the bores 120, 121, the base plate 102 is provided on the underside with plugs 130, the center lines of which are axially aligned with the center lines of the bores. In known manner, the plugs are formed with mutually opposite longitudinal slots and have a serrated outside peripheral surface.

Adjacent to the projections 115, 116 the bores 120, 121 have length portions 131 which have a diameter that is at least as large as the diameter of the screw threads of the fixing screw 123. Said length portion 131 of the bore is adjoined via a step by a length portion 132 of the bore which is smaller in diameter and which is adapted to be tapped by the screw threads of the associated fixing screw 123 for a preliminary assembling.

I claim:

1. A base plate assembly for mounting a hinge bracket of a furniture hinge, said base plate assembly comprising a base plate adapted to be secured to a carrying wall by fixing screws, and a cover plate at least partly covering the base plate and guided on the base plate transversely to the hinge bracket and provided with means for fixing the hinge bracket, wherein the base plate is formed in its end portions with bores for receiving fixing screws, said bores registering with intermediate portions of slots formed in luglike lateral extensions of the cover plate and extending on a line connecting said bores, and said bores are defined at least in part by projections, said projections serving as guides for side faces of the slots.

2. A base plate assembly according to claim 1, characterized in that the projections are collarlike and extend through the slots in the cover plate, said cover plate bearing on the base plate, and in that the projections protrude above top surfaces of the extensions, the cover plate and particularly one of its extensions is formed with a third slot parallel to the slots formed in said luglike lateral extensions, and a headed clamp screw extends through said third slot and is screwed into a tapped bore in the base plate.

3. A base plate assembly according to claim 1, characterized in that the projections have the same width as the slots.

4. A base plate assembly according to claim 1, characterized in that the projections are provided in the slots only on mutually opposite sides of the bores in the base plate and the width of the projections equals the diameter of the bores in the base plate.

5. A base plate assembly according to claim 1, characterized in that the base plate is substantially rectangular and the cover plate is cross-shaped.

6. A base plate assembly according to claim 1, characterized in that the cover plate is symmetrical with respect to its longitudinal center line.

7. A base plate assembly according to claim 1, characterized in that the projections serve to guide the cover plate on the base plate.

8. A base plate assembly according to claim 1, characterized in that the cover plate is formed in its underside surface with a transverse groove having end portions disposed in the lateral extensions, and the cover plate is guided by contact of the side faces of the groove with side edges of the base plate.

9. A base plate assembly according to claim 8, characterized in that the groove is interrupted in a intermediate portion of the cover plate and said intermediate portion of the cover plate is formed with a projection for retaining the hinge bracket.

10. A base plate assembly according to claim 1, characterized in that one of the projections is short so that it terminates in one of the slots below a top edge of the one of the slots.

11. A base plate assembly according to claim 1, characterized in that the projections are of the base plate and extend in and along only part of the height of the slots formed in the cover plate.

12. A base plate assembly according to claim 11, characterized in that the cover plate is made of sheet steel.

13. A base plate assembly according to claim 12, characterized in that the luglike extensions of the cover plate are provided with depending peripheral flanges.

14. A base plate assembly according to claim 13, characterized in that the depending peripheral flanges are U-shaped and merge via rounded corner portions into mutually parallel depending side edge flanges of an intermediate portion of the cover plate, said intermediate portion serving to retain the hinge bracket.

15. A base plate assembly according to claim 13, characterized in that the depending peripheral flanges of the luglike extensions of the cover plate cover adjacent side edge faces of the base plate and define a clearance with said side edge faces.

16. A base plate assembly according to claim 11, characterized in that the base plate consists of an injection molding made of plastic.

17. A base plate according to claim 11, characterized in that the projections of the base plate are generally rectangular in a top plan view.

18. A base plate assembly according to claim 11, characterized in that the projections of the base plate are in an interference fit with an intermediate portion of the slots.

19. A base plate assembly according to claim 11, characterized in that the base plate is integrally formed on its underside with plugs, which are formed with openings which constitute continuations of said bores.

20. A base plate assembly according to claim 11, characterized in that each bore in the base plate has a portion which is smaller in diameter than screw threads of its associated fixing screw.

21. A base plate assembly according to claim 20, characterized in that those portions of the bores which are smaller in diameter are adjacent to a plane defined by the base plate.

22. A base plate assembly according to claim 1, characterized in that each bore in the base plate has a portion which is defined by the projections and which has a diameter is at least as large as the diameter of its associated fixing screw.

* * * * *